US007758668B1

(12) United States Patent
Wu

(10) Patent No.: US 7,758,668 B1
(45) Date of Patent: Jul. 20, 2010

(54) PROCESS OF MANUFACTURING METALLIC NANO-SCALE POWDERS

(75) Inventor: Wei Wu, Ann Arbor, MI (US)

(73) Assignee: Chemnano, Inc., Ann Arbor, MI (US)

( * ) Notice: Subject to any disclaimer, the term of this patent is extended or adjusted under 35 U.S.C. 154(b) by 421 days.

(21) Appl. No.: 11/787,647

(22) Filed: Apr. 17, 2007

Related U.S. Application Data

(60) Provisional application No. 60/792,855, filed on Apr. 18, 2006.

(51) Int. Cl.
*B22F 9/22* (2006.01)

(52) U.S. Cl. ..... 75/362; 75/369; 75/370

(58) Field of Classification Search ..... None
See application file for complete search history.

(56) References Cited

U.S. PATENT DOCUMENTS

| | | | | |
|---|---|---|---|---|
| 3,955,961 | A | 5/1976 | Jordan | |
| 4,751,070 | A * | 6/1988 | Pai Verneker | 423/594.1 |
| 5,711,783 | A | 1/1998 | Schloh | |
| 5,759,230 | A | 6/1998 | Chow | |
| 5,776,264 | A * | 7/1998 | McCandlish et al. | 148/237 |
| 6,676,729 | B2 | 1/2004 | Sun | |
| 6,974,493 | B2 | 12/2005 | Harutyunyan | |
| 2002/0018896 | A1 | 2/2002 | Fukunaga | |
| 2003/0121364 | A1 | 7/2003 | Sun | |
| 2004/0050207 | A1 | 3/2004 | Wooldridge | |
| 2004/0235650 | A1 * | 11/2004 | Saleh et al. | 502/258 |

OTHER PUBLICATIONS

Seisenbaeva, G.A., et al., "Heterometallic Alkoxide Complexes of Variable Composition—A New Way to Ultrafine Powders of Metal Alloys", J. of Sol-Gel Science and Technology, vol. 19, pp. 285-288, 2000.*

* cited by examiner

*Primary Examiner*—George Wyszomierski
(74) *Attorney, Agent, or Firm*—Brinks Hofer Gilson & Lione

(57) ABSTRACT

A process for synthesizing metal submicron and nano-scale powders for use in articles of manufacture. In a suitable reactor, single metal or multiple metal complexes are heated to a temperature whereby, upon contact with hydrogen gas, an exothermic reaction begins. The further temperature rise in response to the exothermic reaction is minimized by reducing the external heat input, thereby minimizing the agglomeration or sintering of the metal nano-scale particles resulting from the process. Preferably, after drawing a vacuum on the metal complexes in the reactor, the hydrogen is introduced at above, equal to or below ambient pressure and the reaction is purposely made slow to prevent agglomeration or sintering.

20 Claims, 6 Drawing Sheets

PROCESS OF MANUFACTURING METALLIC NANO-SCALE POWDERS

This application claims the benefit of provisional patent application No. 60/792,855, filed Apr. 18, 2006.

TECHNICAL FIELD OF THE INVENTION

The present invention relates to methods of producing sub-micron powders, nanoparticles and articles made therefrom.

BACKGROUND OF THE INVENTION

Powders are used in numerous applications. Powders are the building blocks of catalytic, electronic, telecommunication, electrical, magnetic, structural, optical, biomedical, chemical, thermal, and consumer goods. On-going market demands for more efficient, reliable, smaller, faster, superior, and more portable products have demanded miniaturization of numerous products. This, in turn, has demanded miniaturization of the building blocks, i.e. the powders. Nano-scale (or nanosize, ultra-fine) powders, with a size of 10 to 100 times smaller than conventional micron size powders, enable quality improvement and differentiation of product characteristics at scales currently unachievable by commercially available micron-sized powders.

Nano-scale powders, in particular, are a novel family of materials whose distinguishing features include a domain size so small that size confinement effects become a significant determinant of the materials' performance. Such confinement effects can, therefore, lead to a wide range of commercially important properties. Thus, nano-scale powders offer an extraordinary opportunity for design, development, and commercialization of a wide range of devices and products for various applications. Furthermore, since they represent a whole new family of material precursors where conventional coarse-grain physiochemical mechanisms are not applicable, these materials offer unique combination of properties that can enable novel and multifunctional components of unmatched performance. Other examples of sub-micron and nano-scale powder applications are described in U.S. Pat. No. 5,984,997, which is hereby incorporated by reference along with the references contained therein.

Traditional methods of producing fine metal powders chiefly involve plasma reactions, such as the process described in European Patent Application Publication EP1619000169, which is hereby incorporated by reference, or the condensation from gas and liquid phase described in U.S. Patent Application Publication No. 20050277297, which is hereby incorporated by reference. These known methods require relatively high temperatures exceeding several hundred degrees Celsius so that metal grain sizes can rapidly grow during sintering. Moreover, these methods are inefficient and do not typically produce nano-scale powders. These methods also consume a large amount of energy, and, therefore are expensive. Likewise, the production of metal powders from hydrogen reduced oxides is a well known technique; however, this process suffers from similar drawbacks. The great expense associated with traditional techniques of producing fine metal particles limits the applications in which the metal particles can be used.

U.S. Pat. No. 3,955,961 discloses processes for reducing certain metal carboxylates with hydrogen or carbon monoxide under low moisture conditions, relatively low temperatures and preferably high pressures. The patent teaches starting with relatively large (2.5 cm) pellets, increasing the hydrogen pressure to speed up the reaction rate and allowing the exothermic reaction to raise the temperature well above the beginning temperatures to thereby increase the production rate and decrease cost. The patent issued at a time (1976) long before the possible manufacture of submission or nanoparticles was seriously contemplated.

SUMMARY OF THE INVENTION

In general, the present invention provides a process for synthesizing metal powders comprising the step of heating a solid metal complex to a low temperature above ambient, the step of chemically reacting the metal complex with hydrogen in a low temperature environment, and the step of carefully limiting the temperature rise caused by the exothermic reaction ensuing to thereby minimize the agglomeration or sintering of the metal particles resulting from the process.

Another aspect of the present invention provides particles produced by processing for at least one substantially pure metal submicron or nano-scale powder for inclusion in subsequent products.

DETAILED DESCRIPTION OF THE PREFERRED EMBODIMENTS

I. Definitions

Figure 1:
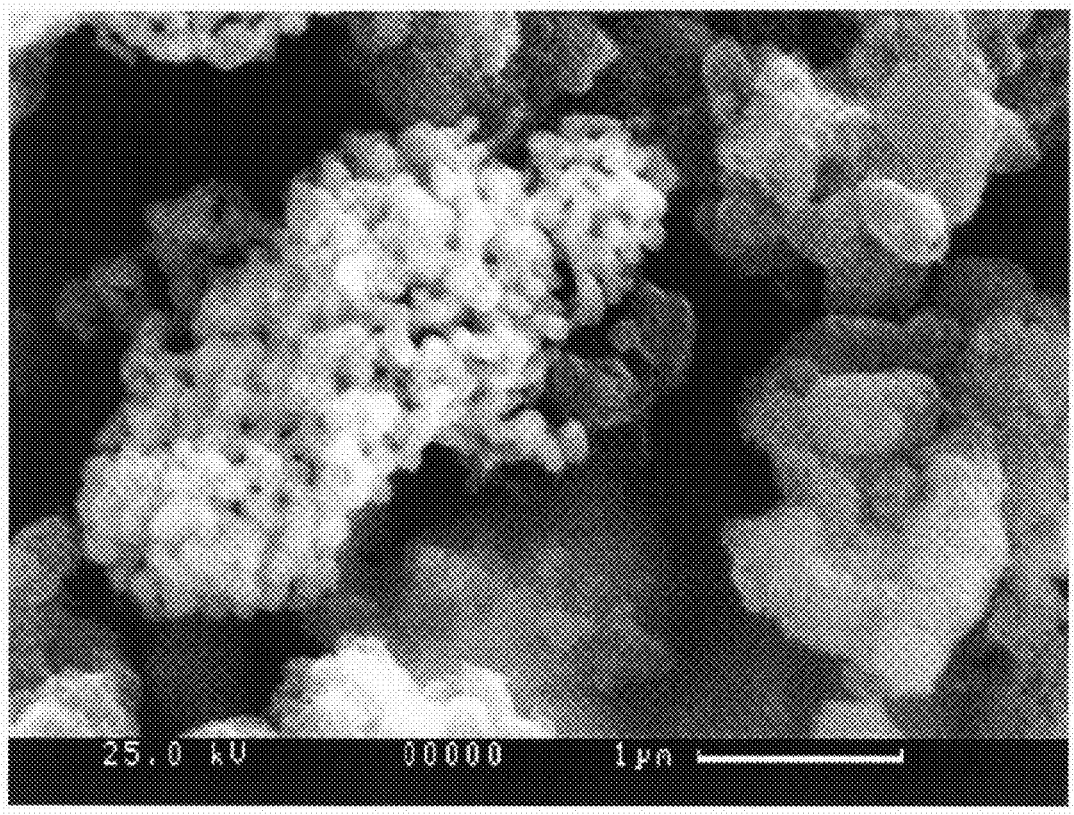
FIG. 1 is a scanning electron microscope picture of exemplary particles synthesized using the process of the present invention (1 μm reference).
Figure 2:
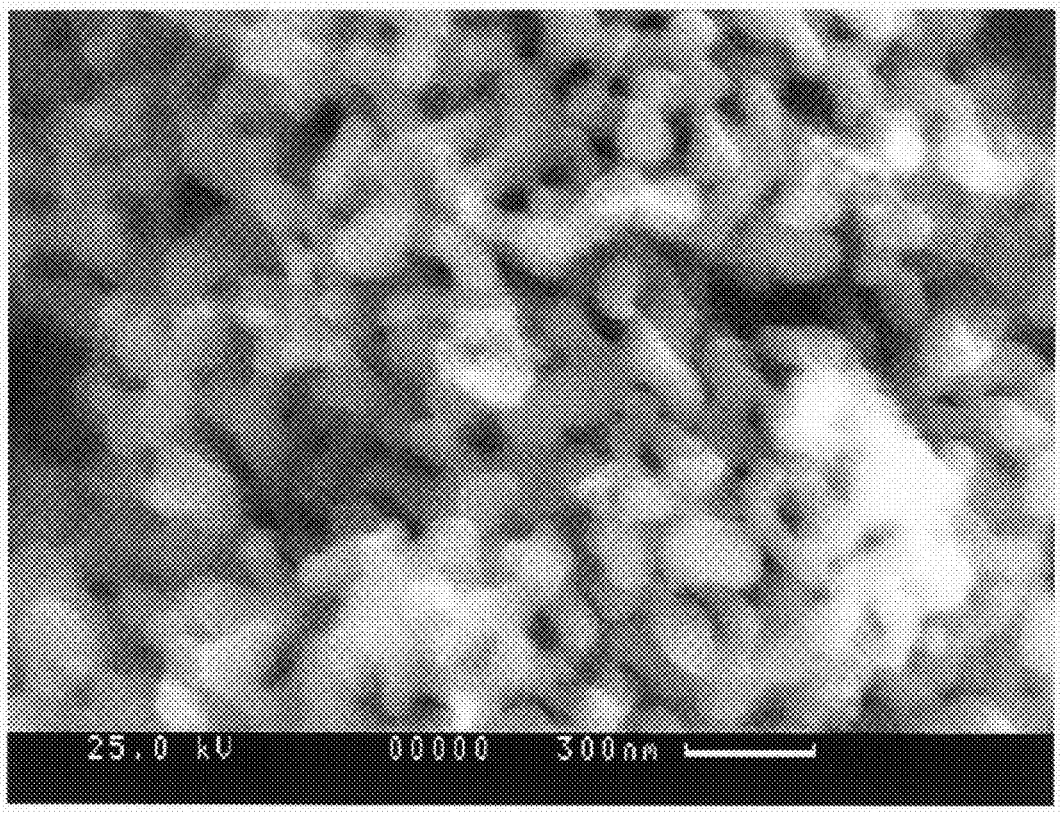
FIG. 2 is a scanning electron microscope picture of exemplary particles synthesized using the process of the present invention (300 nm reference).
Figure 3:
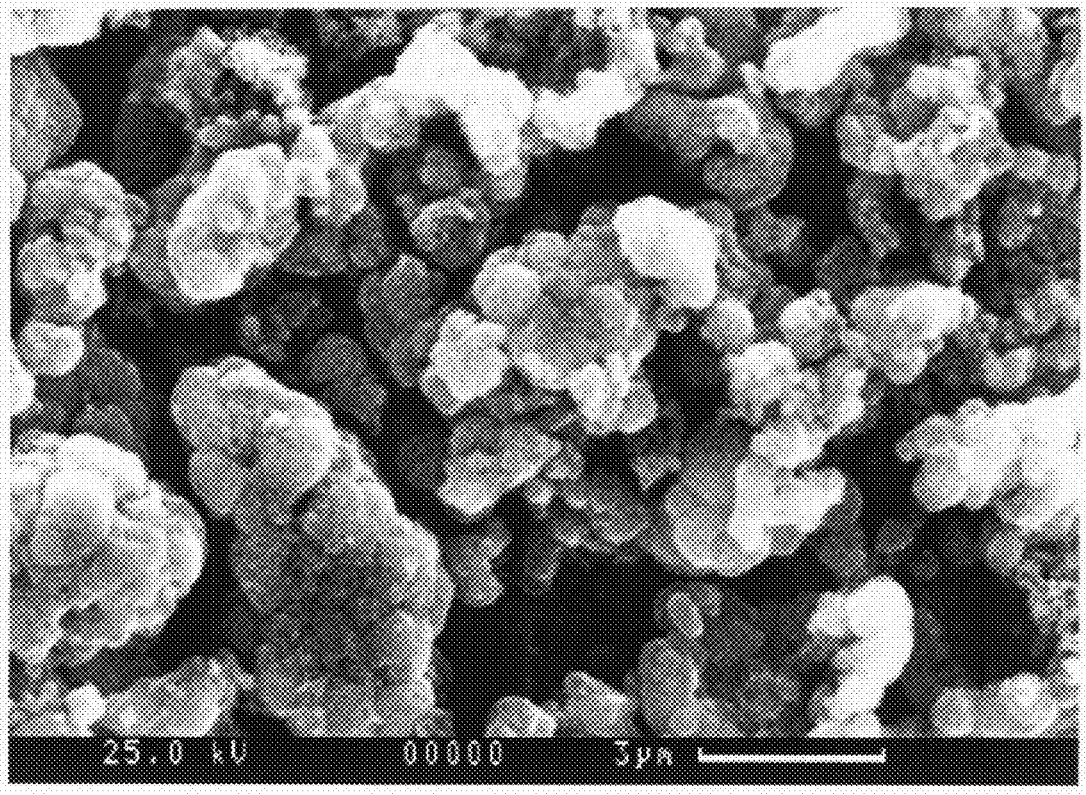
FIG. 3 is a scanning electron microscope picture of exemplary particles synthesized using the process of the present invention (3 μm reference).
Figure 4:
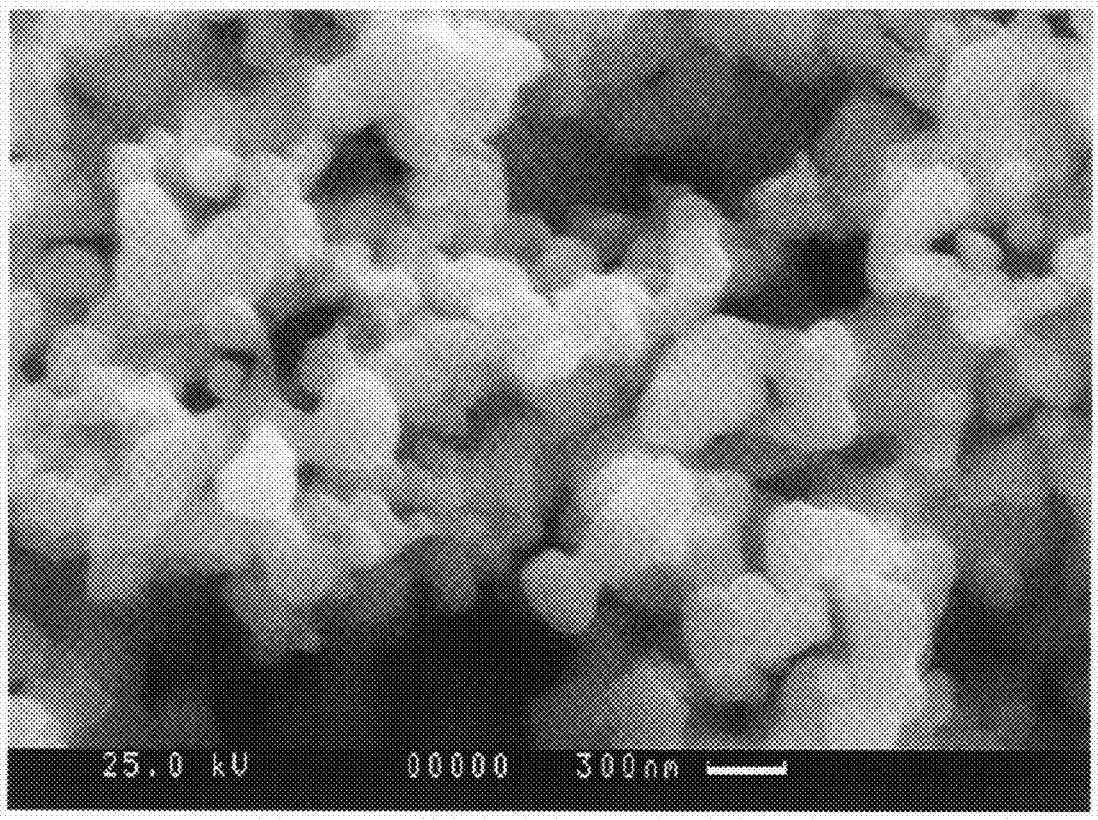
FIG. 4 is a scanning electron microscope picture of exemplary particles synthesized using the process of the present invention (300 nm reference).
Figure 5:
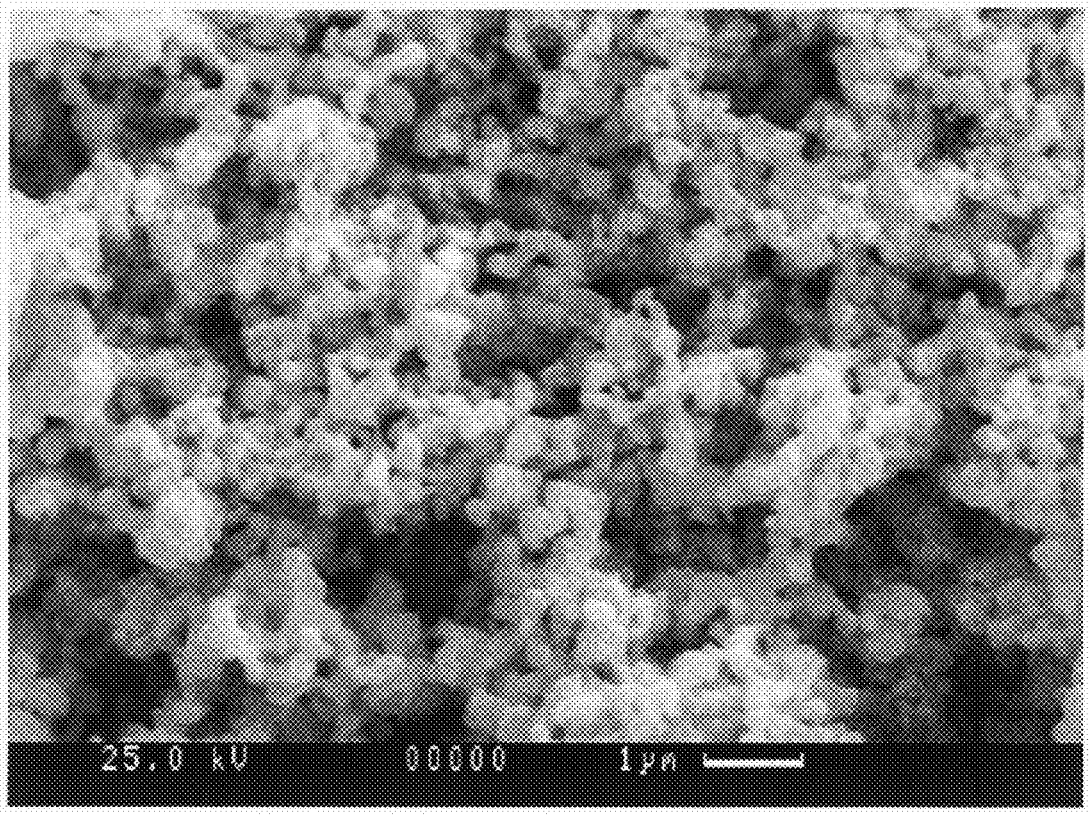
FIG. 5 is a scanning electron microscope picture of exemplary particles synthesized using the process of the present invention (1 μm reference).
Figure 6:
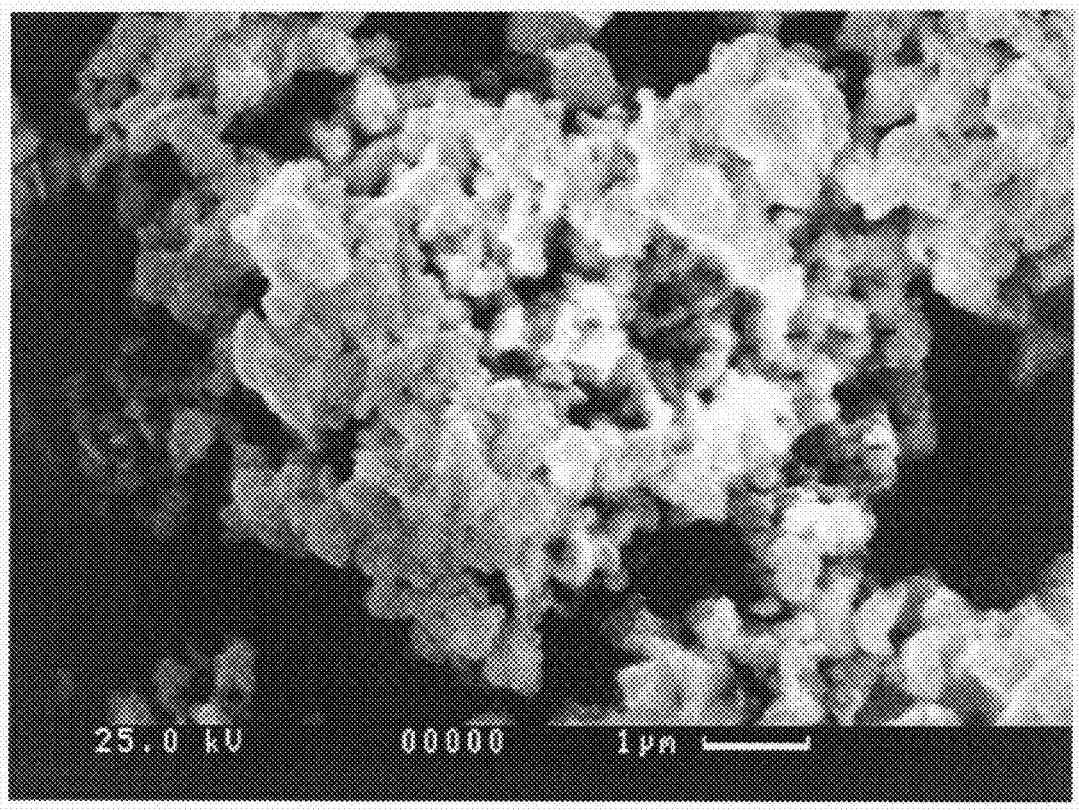
FIG. 6 is a scanning electron microscope picture of exemplary particles synthesized using the process of the present invention (1 μm reference).

As used herein, "nano-sized", "nano-scale", or "nanoparticle" refers to a particle with an average particle size of about 100 nm or less (e.g., less than about 95 nm, less than about 80 nm, less than about 70 nm, or less than about 65 nm). The average particle size for nanoparticles refers to at least one dimension of the resulting metallic particles, which may be of any shape, e.g., spherical, eliptical, rectangular or irregular, having an average value of about 100 nm or less. Some nanoparticles may have more than one dimension which, on average, has a value of about 100 nm or less. The average dimension can be referred to as a $D_{50}$ value.

As used herein, "sub-micron" refers to a particle with an average particle size of more than 100 nm to about 1 μm (e.g., more than 200 nm to about 900 nm or more than 300 nm to about 700 nm). The average particle size refers to the dimensions of the resulting metallic particles, which may be of any shape, e.g., spherical, eliptical, rectangular or irregular. The average dimensions of sub-micron metallic particles are between about 100 nm to about 1 μm. The average dimension can be referred to as a $D_{50}$ value.

As used herein, "micro" refers to a particle with an average particle size of more than 1 μm to about 900 μm.

As used herein, "low temperature" refers to temperatures from about 20° C. to about 700° C.

As used herein, a "metal complex" refers to a compound having at least one metal atom wherein the metal atom is bonded to one or more ligands. Metal complexes comprising more than one metal atom may comprise two or more metal atoms of the same element or they may comprise two or more metal atoms of the different elements. Metal complexes include metal salts and metal chelates. Examples of metal complexes include metal carbonates, metal citrates, metal oxalates, metal carbazides, metal glycines, metal hydroxides, or the like.

As used herein, a "metal atom" is an electropositive atom having an atomic number of 3 to 94. Examples of metal atoms include, without limitation Cr, Mn, Fe, Co, Ni, Cu, Zn, Ga, Ge, Mo, Ru, Rh, Pd, Ag, Cd, In, Sn, W, Re, Os, Ir, Pt, Au, Hg, Ti, Pb, Bi, or the like.

As used herein, "metal powder" refers to powders comprising a pure elemental metal (e.g., pure Au, Ag, Pt, Fe, Ni, or the like) and metal alloys, wherein a metal alloy is a combination, either in solution or compound, of two or more elemental metals, and where the resultant material has metallic properties. Examples of metal alloys includes, without limitation, bronze, brass, aluminum alloys, nickel alloys, titanium alloys, iron alloys (e.g., stainless steel), magnesium alloys, or the like.

As used herein, a "reducing agent", a "reductant", or a "reducer" is a substance that chemically reduces other substances by donating an electron or electrons, and reduction describes the gain of one or more electrons by a molecule, atom or ion.

As used herein, an "oxidizing agent", an oxidizer, or an "oxidant" refers to substances that have the ability to oxidize other substances by removing an electron or electrons, and oxidation describes the loss of one or more electrons by a molecule, atom or ion.

As used herein, "average particle size" refers to the length of at least one dimension of at least one side of a particle as determined using Scanning Electron Microscopy, Transmission Electron Microscopy, and/or Light Scattering techniques known to those skilled in the art.

As used herein, "surface area" refers to the summation of the areas of the exposed sides of an object. The surface area of fine powders and nano-scale powders of the present invention was determined using $N_2$ gas adsorption to calculate the BET surface area. The BET equation for calculating surface area is expressed by (1):

$$\frac{1}{\upsilon[(P_0/P)-1]} = \frac{1}{\upsilon_m c}\left(\frac{P}{P_0}\right) + \frac{1}{\upsilon_m} \tag{1}$$

wherein P and $P_0$ are the equilibrium and the saturation pressure of adsorbates at the temperature of adsorption, ν is the adsorbed gas quantity (for example, in volume units), and $\nu_m$, is the monolayer adsorbed gas quantity. c is the BET constant, which is expressed by (2):

$$c = \exp\left(\frac{E_1 - E_L}{RT}\right) \tag{2}$$

wherein $E_1$ is the heat of adsorption for the first layer, and $E_L$ is that for the second and higher layers and is equal to the heat of liquefaction.

Equation (1) is an adsorption isotherm and can be plotted as a straight line with $1/\nu[(P_o/P)-1]$ on the y-axis and $P/P_0$ on the x-axis according to experimental results. This plot is called a BET plot. The linear relationship of this equation is maintained only in the range of $0.05<P/P_0<0.35$. The value of the slope and the y-intercept of the line are used to calculate the monolayer adsorbed gas quantity $\nu_m$ and the BET constant c.

The BET method is widely used in surface science for the calculation of surface areas of solids by physical adsorption of gas molecules. A total surface area $S_{total}$ and a specific surface area S are evaluated by the following equations:

$$S_{total} = \frac{(\upsilon_m N_s)}{M}$$

$$S = \frac{S_{total}}{a}$$

wherein N is Avogadro's number, s is adsorption cross section, M is molecular weight of adsorbate, and a is the weight of the sample solid.

II. Synthesis of the Submicron and Nano-Scale Powders

The present invention provides a process for synthesizing metal powders including the step of heating one or more metal complexes to a sufficient but low temperature above ambient, the step of contacting the metal complex with hydrogen gas ($H_2$) at the low temperature and upon exothermic reaction the step of carefully limiting the temperature rise caused by the exothermic reaction to thereby minimize the agglomeration or sintering of metallic particles produced by the reaction. The reaction is continued for a sufficient period of time with the hydrogen gas at a suitable pressure, whereby the hydrogen gas contacts the metal complex at the controlled low temperature for a sufficient period of time to form metal nanoparticles and/or sub-micron particles. The object of the process is to produce substantially pure metal nanoparticles and/or sub-micron particles. Temperatures that are suitable for the present invention are sufficiently controlled so that when the metal complex contacts the hydrogen gas for an adequate period of time, metal nanoparticles and/or sub-micron particles are formed but larger particles are minimized. Periods of time suitable for the hydrogen to contact the metal complex have a duration, at the expiration of which, the metal complex and the hydrogen gas have been in contact to form substantially pure metal nanoparticles and/or sub-micron particles from substantially all of the metal complex present. Prior to contacting with hydrogen gas preferably, a vacuum is drawn on the metal complexes in the reactor. Suitable pressures for hydrogen gas include pressures that are above atmospheric pressure, substantially equal to atmospheric pressure, or below atmospheric pressure.

Substantially pure metal powders synthesized using the process of the present invention include pure elemental metal powders (e.g., gold powder, nickel powder, copper powder, iron powder, or the like, each having a purity of greater than about 80%, greater than about 90%, greater than about 95%, or greater than about 99%) and powders of metal alloys (e.g., brass powder, bronze powder, or titanium alloy powder, each having a purity of greater than about 80%, greater than about 90%, greater than about 95%, or greater than about 99%). In fact, the metal powders produced using the process of the present invention do not have substantially passivated surfaces if the process is allowed to continue to substantial completion.

Without intending to be limited by theory, it is theorized that when the metal complex reacts with hydrogen gas ($H_2$) at a low controlled temperature, each metal cation is reduced by the hydrogen gas to form the neutrally charged metal while the metal complex anion and/the hydrogen gas are oxidized and expelled from the reactor.

In examples of the embodiment, the present invention provides a process for synthesizing substantially pure elemental metal nanoparticles comprising the step of heating a metal complex in a reactor to a temperature of 700° C. or less and drawing a vacuum thereon (e.g., from about 80° C. to about 300° C., from about 150° C. to about 300° C., or from about 240° C. to about 260° C.; or about 300° C. or less, 290° C. or less, 280° C. or less, or about 275° C. or less); and the step of contacting the metal complex with hydrogen gas having a suitable pressure in the reactor at a controlled reaction temperature of less than 700° C. for a period of about 20 minutes to about 10 hours (e.g., about 1 hours to about 5 hours, about 2 hours to about 4.5 hours; or for a period of about 1 hour or more, 2 hours or more, 3 hours or more, 4 hours or more, or the like).

In another embodiment, the present invention provides a process for synthesizing substantially pure elemental metal submicron or nanoparticles comprising the step of heating a mixture of two or more metal complexes, the step of contacting the mixture with hydrogen, wherein the metal complexes each have a metal atom of the same element (e.g., Ni, Cu, Co, Fe, or the like), but the metal complexes have differing ligands, i.e., at least one ligand attached to one metal atom of one metal complex being different from ligands on the metal atoms of other metal complexes. For example, in one specific embodiment, a process for synthesizing substantially pure nickel (Ni) nanoparticles and/or sub-micron particles comprises the step of heating a mixture of two metal complexes to a temperature of about 150° C. to about 300° C., wherein the mixture comprises a first metal complex of nickel hydroxide and a second metal complex of nickel carbonate hydrate; the step of contacting the mixture with hydrogen gas having a suitable pressure in an environment having a controlled temperature of less than 300° C. and the step of maintaining the controlled temperature for a period of about 3 hours to about 4 hours.

In another embodiment, the present invention provides a process for synthesizing a powder having a mixture of substantially pure elemental metal submicron or nanoparticles comprising the step of heating a mixture of two or more metal complexes to a sufficient temperature for reaction with hydrogen gas, the step of contacting the mixture with hydrogen gas and the step of limiting the temperature of the resulting exothermic reaction to minimize agglomeration or sintering of the metal particles formed from the reaction, wherein each of the metal complexes has at least one unique metal atom, i.e., at least one metal atom of an element that differs from at least some of the other metals in the metal complexes, for a sufficient period of time to substantially complete the reaction of hydrogen gas with the metal complexes.

In several embodiments, the present invention provides a method for synthesizing metal alloy nanoparticles comprising the step of heating a mixture of two or more metal complexes to a sufficient temperature, and the step of contacting the mixture with hydrogen gas, followed by controlling the reaction temperature wherein each of the metal complexes has at least one unique metal atom, i.e., at least one metal atom of an element that is not present in the other metal complex, for a sufficient period of time.

In the alternative embodiments, the metal powders are synthesized by heating one or more metal complexes, such as metal carbonates, metal citrates, metal oxalates, metal carbazides, metal glycines, metal hydroxides, or the like, wherein the complexes include one or more metals such as Cr, Mn, Fe, Co, Ni, Cu, Zn, Ga, Ge, Mo, Ru, Rh, Pd, Ag, Cd, In, Sn, W, Re, Os, Ir, Pt, Au, Hg, Ti, Pb, Bi or the like to a temperature of less than 700° C.; and reacting the metal complex with hydrogen at a temperature of less than 700° C. under a carefully controlled time/temperature relationship. The resulting metal powder comprises nanoparticles and/or sub-micron particles. Moreover, the resulting metal powder can also have a surface area of more than 3 $m^2/g$ (e.g. more than 5 $m^2/g$, more than 10 $m^2/g$, more than 20 $m^2/g$, more than 30 $m^2/g$, more than 50 $m^2/g$, or more than 80 $m^2/g$). Surface area is critical for use as a catalyst for example.

Nanoparticles synthesized using the process of the present invention can undergo further processing, such as sintering, to form sub-micron particles or micro particles, if so desired.

Another aspect of the present invention provides a process of directly synthesizing substantially pure sub-micron metal particles comprising the step of heating a metal complex to a sufficiently high temperature (e.g., less than 300° C., less than 350° C., less than 450° C., less than 550° C., or less than 750° C.) and the step of contacting the metal complex with hydrogen at the sufficiently high temperature for a sufficient period of time (e.g., about 1 hour to about 5 hours, about 2 hours to about 4.5 hours; or for a period of about 1 hour or more, 2 hours or more, 3 hours or more, 4 hours or more, or the like) such that the interaction between the hydrogen and the metal complex forms substantially pure sub-micron metal particles. The higher temperature provides for the partial agglomeration or sintering to the larger size particles as desired.

A further aspect of the present invention broadly provides a process of synthesizing substantially pure sub-micron elemental metal particles comprising the step of heating at least one metal complex, and the step of contacting the metal complex with hydrogen at a sufficiently high but controlled temperature for a sufficient period of time such that the interaction between the hydrogen and the metal complex forms substantially pure sub-micron elemental metal particles.

Another aspect of the present invention provides a method of synthesizing substantially pure sub-micron metal alloy particles comprising the step of heating a mixture of 2 or more metal complexes, and the step of contacting the mixture with hydrogen at a sufficiently high but controlled temperature for a sufficient period of time such that the interaction between the hydrogen and the metal complex forms substantially pure sub-micron metal alloy particles.

Metal powders synthesized using the process of the present invention (e.g., the production of metal nanoparticles and/or sub-micron particles) can undergo further processing (such as sintering) to modify the powder properties, such as increase the particle size, impart a magnetic carrier, or the like. Moreover, powders synthesized using the process of the present invention can be molded or cast into forms using known manufacturing methods, or the powders can be mixed with polymers (e.g., thermoplastics, thermosets, elastomers, or the like) or other metals and processed by molding or casting into forms. Powders of the present invention can be mixed with adhesives, bonding materials, molding compounds, or fluid carriers such as solvents, paints, surface treatments, atmospheric gases, or the like.

III. Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A process for synthesizing a substantially pure metal powder comprising the steps of:

heating a mixture of two or more metal complexes to a low temperature, the two or more metal complexes having a metal atom of the same element, but the two or more metal complexes having differing ligands, contacting the mixture with hydrogen gas at the low temperature causing an exothermic reaction, and controlling the temperature rise of the exothermic reaction to minimize the agglomeration of the metallic particles produced by the reaction.

2. The process of claim 1, wherein the two or more metal complexes include nickel hydroxide and a nickel carbonate hydrate.

3. The process of claim 2, wherein the metal complexes are heated to a temperature of less than 700° C.

4. The process of claim 2 wherein the metal powder comprises nickel submicron particles.

5. The process of claim 1, wherein the metal powder comprises nickel nanoparticles.

6. The process of claim 1, wherein the metal powder has a surface area of 3 $m^2/g$ or more.

7. The process of claim 1, wherein a vacuum is drawn on the metal complexes prior to contact with hydrogen gas.

8. The process of claim 1, wherein the metal complexes are selected from the group consisting of a metal citrate, a metal oxalate, a metal carbazide, a metal glycine, and a metal hydroxide.

9. The process of claim 8, wherein the metal complexes include at least one metal selected from the group consisting of Cr, Mn, Fe, Co, Ni, Cu, Zn, Ga, Ge, Mo, Ru, Rh, Pd, Ag, Cd, In, Sn, W, Re, Os, Ir, Pt, Au, Hg, Ti, Pb, and Bi.

10. The process of claim 1, wherein a vacuum is drawn on the metal complex prior to contact with hydrogen gas.

11. The process of claim 1, wherein the step of controlling the temperature rise includes substantially maintaining the low temperature.

12. A process for synthesizing a metal powder comprising the steps of:

heating a mixture of two or more metal complexes to a temperature below 700° C., the two or more metal complexes have a metal atom of the same element, but the two or more metal complexes have differing ligands, contacting the metal complexes with hydrogen gas causing an exothermic reaction, and limiting the temperature rise caused by the exothermic reaction to minimize the agglomeration of metallic particles produced by the reaction.

13. The process of claim 12, wherein the metal complexes are selected from the group consisting of a metal citrate, a metal oxalate, a metal carbazide, a metal glycine, and a metal hydroxide.

14. The process of claim 13, wherein the metal complexes include at least one metal selected from the group consisting of Cr, Mn, Fe, Co, Ni, Cu, Zn, Ga, Ge, Mo, Ru, Rh, Pd, Ag, Cd, In, Sn, W, Re, Os, Ir, Pt, Au, Hg, Ti, Pb, and Bi.

15. The process of claim 12, wherein a vacuum is drawn on the metal complex prior to contact with hydrogen gas.

16. The process of claim 12, wherein the metal powder comprises nanoparticles.

17. The process of claim 12, wherein the metal powder comprises sub-micron particles.

18. The process of claim 12, wherein the metal powder has a surface area of 3 $m^2/g$ or more.

19. The process of claim 12, wherein the metal powder comprises sub-micron particles.

20. The process of claim 12, wherein the step of limiting the temperature rise includes substantially maintaining the temperature.

* * * * *